US007472672B2

(12) United States Patent
Asada et al.

(10) Patent No.: US 7,472,672 B2
(45) Date of Patent: Jan. 6, 2009

(54) STARTING APPARATUS

(75) Inventors: Toshiaki Asada, Mishima (JP); Shuichi Ezaki, Susono (JP); Makoto Ishikawa, Aichi-ken (JP); Kazuhito Sakai, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/596,808

(22) PCT Filed: Aug. 5, 2005

(86) PCT No.: PCT/JP2005/014800

§ 371 (c)(1),
(2), (4) Date: Dec. 13, 2007

(87) PCT Pub. No.: WO2006/016668

PCT Pub. Date: Feb. 16, 2006

(65) Prior Publication Data

US 2008/0121202 A1 May 29, 2008

(30) Foreign Application Priority Data

Aug. 9, 2004 (JP) ..... 2004-232704

(51) Int. Cl.
*F02N 5/04* (2006.01)

(52) U.S. Cl. ..... 123/179.25; 290/38 R; 74/7 E

(58) Field of Classification Search ..... 123/179.25, 123/179.28, 185.14; 310/78, 83; 464/38; 475/153, 263; 74/7 E; 290/38 R; 192/42, 192/63

See application file for complete search history.

(56) References Cited

U.S. PATENT DOCUMENTS 3,686,961 A * 8/1972 Campbell ..... 74/7 R (Continued)

FOREIGN PATENT DOCUMENTS

EP 1 439 305 A2 7/2004

(Continued)

*Primary Examiner*—Stephen K Cronin
*Assistant Examiner*—Hung Q Nguyen
(74) *Attorney, Agent, or Firm*—Oliff & Berridge, PLC

(57) ABSTRACT

Engine starting apparatus comprising a one way clutch. A first oil seal is located on the outer side of a second oil seal in the radial direction of a ring gear. Upon starting of an engine, the time that the first oil seal is slid on the ring gear is short, and after the start of the engine, the first oil seal is not slid on the ring gear. The second oil seal is located on the inner side of the first oil seal in the radial direction of the ring gear. Therefore, the second oil seal hardly deteriorates even if slid on a flywheel at high speed after the start of the engine. By locating the first and second oil seals at different positions in the radial direction of the ring gear, it is possible to improve the startability and the lifetime of a starting apparatus. At least one oil seal has a taper shape in order to generate a thrust force which forces the ring gear away from the flywheel.

15 Claims, 5 Drawing Sheets

U.S. PATENT DOCUMENTS

| | | | | |
|---|---|---|---|---|
| 4,848,170 | A * | 7/1989 | Inagaki et al. | 74/6 |
| 4,855,609 | A * | 8/1989 | Eguchi et al. | 290/48 |
| 5,018,611 | A * | 5/1991 | Hasebe | 192/42 |
| 5,111,093 | A * | 5/1992 | Tanaka | 310/88 |
| 5,165,293 | A * | 11/1992 | Kittaka et al. | 74/7 A |
| 5,877,575 | A * | 3/1999 | Nara et al. | 310/239 |
| 5,943,909 | A * | 8/1999 | Soh | 74/6 |
| 6,142,028 | A * | 11/2000 | Soh | 74/7 C |
| 6,378,479 | B1 * | 4/2002 | Nishidate et al. | 123/179.25 |
| 6,880,415 | B2 * | 4/2005 | Nito | 74/6 |
| 6,932,042 | B2 * | 8/2005 | Murata et al. | 123/179.25 |
| 2003/0197384 | A1 * | 10/2003 | Vuk | 290/38 R |
| 2004/0026926 | A1 * | 2/2004 | Kajino et al. | 290/38 R |
| 2004/0107932 | A1 * | 6/2004 | Murata et al. | 123/179.25 |
| 2004/0250784 | A1 * | 12/2004 | Kajino et al. | 123/179.25 |
| 2005/0045135 | A1 * | 3/2005 | Taylor et al. | 123/179.25 |

FOREIGN PATENT DOCUMENTS

| | | |
|---|---|---|
| GB | 627778 | 8/1949 |
| JP | A 02-129454 | 5/1990 |
| JP | A 09-093863 | 4/1997 |
| JP | A 10-220244 | 8/1998 |

* cited by examiner

STARTING APPARATUS

TECHNICAL FIELD

The present invention relates to a starting apparatus appropriate for restarting an engine from an idling stop condition, for example, and particularly, a starting apparatus of a constant mesh gear type, provided with a gear train including a one-way clutch.

BACKGROUND ART

There are conventionally supposed technologies about various starting mechanisms having a one-way clutch. For example, Japanese Patent Application Laying Open NO. Hei 10-220244 discloses a gear support structure of the starting apparatus of a two cycle engine. Japanese Patent Application Laying Open NO. Hei 9-93863 discloses a technology about a fastening structure between a generator and a one-way clutch in an engine.

In particular, in the starting apparatus of an internal combustion engine provided with a one-way clutch, lubricant is supplied into the apparatus in most cases, in order to smoothly operate the apparatus. For example, Japanese Patent Application Laying Open NO. Hei 2-129454 discloses a technology about a one-way clutch lubricating apparatus in an automatic transmission.

On the other hand, from the viewpoint of environmental protection or energy and resource saving, in order to reduce fuel consumption and exhaust gas in idling, recently, there has been an increase in development of a starting apparatus having an economy running system (hereinafter referred to "Ecorun") which automatically stops the internal combustion engine (hereinafter also referred to as an "engine") if a vehicle stops and which automatically restarts the engine from the stop condition if an instruction for starting is given, to thereby start the vehicle.

DISCLOSURE OF INVENTION

The inventors of the present invention recognize the need of the lubricant and the importance of preventing the leakage of the lubricant, even in the starting apparatus applied to the Ecorun, and the inventors conduct various examinations on the set location of an oil seal or the like.

The inventors of the present invention are aware of various problems in conducting the examinations. For example, if the engine is restarted from the idling stop condition, in some cases, the lip sliding surface of the oil seal may be slid at high speed, together with the rotation of the engine, depending on the set location of the oil seal, after the main drive of the engine is started, in the starting apparatus. In order to quickly restart the engine from the idling stop condition, for example, it is desirable to adopt a starting apparatus of a constant mesh gear type (i.e., a constant engaged gear type), in which each gear on one shaft has a matching gear on the opposing gear and the two gears are always meshed or engaged with each other. However, if the constant mesh gear type is adopted, such high-speed sliding may be performed at an arbitrary point near the one-way clutch, in some cases. More specifically, for example, the oil seal located in a surrounding area of a ring gear in the radial direction of the ring gear may be slid on a flywheel which rotates at high speed along with the main drive of the engine, in some cases. An excess heat is generated in the oil seal slid at high speed, and this leads to the deterioration of the oil seal itself. Consequently, this may decrease the reliability of the starting apparatus.

As described above, in order for the starting apparatus to acquire high startability and reliability, it is important not only to smoothly flow the lubricant in the apparatus and reduce the leakage of the lubricant to the exterior of the apparatus, but also to prevent the deterioration of the oil seal.

It is therefore an object of the present invention to provide a starting apparatus having a good starting performance and high reliability.

The above object of the present invention can be achieved by a first starting apparatus for starting an internal combustion engine, which is provided with a flywheel connected to a crankshaft and which has a main body block, the starting apparatus being provided with: a starting motor for generating a rotational force for starting, upon starting of the internal combustion engine; a ring gear for transmitting the rotational force for starting, from a side of the starting motor to a side of the flywheel; a one-way clutch, which is located between the ring gear and the flywheel, for transmitting the rotational force for starting, from a side of the ring gear to the side of the flywheel and preventing transmission of a rotational force for driving of the internal combustion engine, from the side of the flywheel to the side of the ring gear; a first oil seal for oil-sealing a side, which faces to the main body block, of the ring gear; and a second oil seal for oil-sealing a side, which faces to the flywheel, of the ring gear, the first oil seal being located on an outer side of the second oil seal in a radial direction of the ring gear.

According to the first starting apparatus of the present invention, at the start of the internal combustion engine, the ring gear is rotated by the rotational force for starting, generated on the starting motor. The rotational force for starting is transmitted from the starting motor to the flywheel through the one-way clutch, so that the flywheel is rotated together with the ring gear. Therefore, the relative velocity between the ring gear and the flywheel is zero at the start of the internal combustion engine. The main body block is, for example, a cylinder block, and does not rotate at the start of the internal combustion engine. Therefore, at the start of the internal combustion engine, the relative velocity of the main body block and the ring gear which rotates is not zero.

Between the ring gear and the flywheel, there is the one-way clutch for transmitting the rotational force for starting, from the side of the ring gear to the side of the flywheel and for preventing the transmission of the rotational force for driving of the internal combustion engine, from the side of the flywheel to the side of the ring gear. Thus, after the start of the internal combustion engine, i.e. at the time of main drive of the internal combustion engine, the ring gear does not rotate but stops. Therefore, after the start of the internal combustion engine, the relative velocity between the ring gear and the flywheel is not zero. Moreover, after the start of the internal combustion engine, the ring gear stops, so that the relative velocity between the ring gear and the main body block is zero.

Now, the relative velocity on the sliding surface of the first oil seal and the ring gear which slide each other and the relative velocity on the sliding surface of the second oil seal and the flywheel which slide each other will be considered, on ground of the relative velocity among the main body block, the ring gear, and the flywheel at the start and after the start of the internal combustion engine described above.

The first oil seal is fixed on the main body block, for example, and the peripheral velocity of the first oil seal is zero at the start of the internal combustion engine. Therefore, at the start of the internal combustion engine, the relative velocity on the sliding surface of the first oil seal and the ring gear which slide each other is not zero.

However, the lip portion of the first oil seal is only slid on the ring gear in a short time, such as at the start of the internal combustion engine. Moreover, at the start of the internal combustion engine, the ring gear is rotated at a relatively low speed, as a previous stage of the completion of the start of the internal combustion engine. Thus, even if the relative velocity of the first oil seal and the ring gear which slide each other increases by this much that the first oil seal is located on the outer side of the second oil seal in the radial direction of the ring gear, the first oil seal has a small degree of the deterioration, caused by this much of the increase in the relative velocity. Moreover, the first oil seal is located on the side, which faces to the main body block, of the ring gear. Thus, after the start of the internal combustion engine, the relative velocity of the first oil seal and the ring gear is zero. Therefore, after the start of the internal combustion engine, the deterioration caused by the sliding by the ring gear does not occur in the lip portion of the first oil seal.

Incidentally, the first oil seal may be fixed on the side of the ring gear, for example, and the lip portion of the first oil seal may be slid on the main body block. Even in this case, the lip portion of the first oil seal is only slid in a short time, such as at the start of the internal combustion engine.

The second oil seal is fixed on the side of the ring gear, for example, and the lip portion of the second oil seal is slid on the flywheel after the start of the internal combustion engine. However, in the radial direction of the ring gear, the second oil seal is located on the inner side of the first oil seal. Thus, the second oil seal has a small relative velocity with respect to the flywheel which rotates, and this prevents the deterioration of the lip portion of the second oil seal. Moreover, according to the first starting apparatus of the present invention, it is possible to prevent the generation of heat caused by the sliding. For example, if the first and second oil seals are mainly formed of a synthetic resin material, it is possible to prevent the deterioration of the oil seals caused by heat.

Incidentally, the second oil seal may be fixed on the side of the flywheel side, for example, and the lip portion of the second oil seal may be slid on the ring gear. Even in this case, in the radial direction of the ring gear, the second oil seal is located on the inner side of the first oil seal, so that the second oil seal has a small relative velocity with respect to the ring gear, which slides the lip portion of the second oil seal.

According to the first starting apparatus of the present invention, in supplying lubricant, the lubricant is supplied to the one-way clutch by a centrifugal force generated by the rotation of the ring gear. The lubricant is sealed by the first and second oil seals. Thus, it is possible to sufficiently reduce the leakage of the lubricant to the surrounding of the ring gear and to smoothly start the internal combustion engine.

As described above, according to the first starting apparatus of the present invention, it is possible to prevent the deterioration of the first oil seal for oil-sealing the side, which faces to the main body block, of the ring gear (which is simply referred to as "the main body block side" of the ring gear, as the occasion demands) and the second oil seal for oil-sealing the side, facing to the flywheel, of the ring gear (which is simply referred to as "the flywheel side" of the ring gear, as the occasion demands), as well as improving the oil sealability. Thus, it is possible to extend a period of time in which the starting apparatus can be operated without any problems. According to the first starting apparatus of the present invention, it is possible to provide a starting apparatus having a good starting performance and high reliability.

In one aspect of the first starting apparatus of the present invention, said ring gear comprises: a first concavo-convex portion including a first convex portion which projects to the side of said flywheel and a first concave portion which is open to the side of said flywheel; and a second concavo-convex portion including a second convex portion which projects to the side of said main body block and a second concave portion which is open to the side of said main body block, said second concave portion is located on the outer side of the first concave portion in the radial direction, said first oil seal is located in the second concave portion, and said second oil seal is located in the first concave portion.

According to this aspect, the first and second oil seals are located in the first and second concave portions, respectively. Thus, it is possible to reduce the size or thickness of the starting apparatus as a whole, as compared to the case where the first and second oil seals are located on the both sides of a flat ring gear, for example.

The second concave portion is located on the outer side of the first concave portion in the radial direction. Thus, even if the first and second oil seals are located in the first and second concave portions, respectively, it is possible to reduce the thickness of the starting apparatus as a whole, while ensuring a space for each oil seal to be located.

In this aspect, the first concave portion may be located on a reverse side of the second convex portion to be inextricably linked with the second convex portion, the second concave portion may be located on a reverse side of the first convex portion to be inextricably linked with the first convex portion, and an end face of the second oil seal on a side thereof facing to the main body block is located closer to the main body block than an end face of the first oil seal on a side thereof facing to the flywheel is or than a surface of the first convex portion on a side thereof facing to the flywheel is, on a cross section of the ring gear cut in a direction crossing a peripheral direction of the ring gear.

In this aspect, the first concave portion and the second convex portion are located to be inextricably linked with each other in the ring gear. Here, "be inextricably linked with" means that the in order to have a shape which entirely or partially reflects the shape of the second convex portion located on a front side, for example, which is one side of the ring gear, the first concave portion is located on the other side of the ring gear, i.e. on the reverse side if the one side is the front side. In the same manner, the second concave portion and the first convex portion are located to be inextricably linked with each other.

According to this aspect, the end face of the second oil seal on the side thereof facing to the main body block may be located closer to the main body block than the end face of the first oil seal on the side thereof facing to the flywheel is or than the surface of the first convex portion on the side thereof facing to the flywheel, on the cross section of the ring gear cut in the direction crossing the peripheral direction of the ring gear. By that much, it is possible to make the thickness of a portion constructed from the first oil seal, the ring gear, and the second oil seal, smaller than a size obtained by simply adding the thicknesses of the first oil seal, the ring gear, and the second oil seal. More specifically, it is possible to reduce the size or thickness of the starting apparatus as a whole, as compared to the case where the first and second oil seals are located on the both sides of a flat ring gear, for example.

Therefore, it is also possible to reduce the size of the internal combustion engine provided with the starting apparatus according to this aspect. From another standpoint, it is also possible to reduce a space for the starting apparatus according to this aspect to be located, and by that much, it is also possible to increase a space for other mechanisms located around the apparatus.

In another aspect of the first starting apparatus of the present invention, at least one of the first and second oil seals is constructed to generate a thrust force which forces the ring gear away from the flywheel.

In this aspect, it is possible to make the ring gear and the flywheel come out of contact with each other, and it is possible to reduce abrasion and a thrust sound, caused by the sliding of the ring gear on the flywheel.

The above object of the present invention can be also achieved by a second starting apparatus for starting an internal combustion engine, which is provided with a flywheel connected to a crankshaft and which has a main body block, the starting apparatus being provided with: a starting motor for generating a rotational force for starting, upon starting of the internal combustion engine; a ring gear for transmitting the rotational force for starting, to a side of the flywheel; a one-way clutch, which is located between the ring gear and the flywheel, for transmitting the rotational force for starting, from a side of the ring gear to the side of the flywheel and preventing transmission of a rotational force for driving of the internal combustion engine, from the side of the flywheel to the side of the ring gear; a first oil seal for oil-sealing a side, which faces to the main body block, of the ring gear; and a second oil seal for oil-sealing a side, which faces to the flywheel, of the ring gear, at least one of the first and second oil seals being constructed to generate a thrust force which forces the ring gear away from the flywheel.

According to the second starting apparatus of the present invention, as described above, it is possible to improve the sealability of the lubricant, as well as preventing the ring gear from being in contact with the flywheel which rotates at high speed after the start of the internal combustion engine. Therefore, it is possible to reduce the abrasion and the thrust sound of the ring gear and the flywheel.

In one aspect of the first or second starting apparatus of the present invention, the first oil seal extends in a peripheral direction of the ring gear, and a cross sectional form of a sliding portion of the ring gear cut in a direction crossing the peripheral direction in the first oil seal is a taper shape which becomes gradually narrower towards the side of the flywheel to thereby generate the thrust force.

According to this aspect, the cross sectional form of the sliding portion of the ring gear cut in the direction crossing the peripheral direction in the first oil seal is a taper shape which becomes gradually narrower towards the side of the flywheel, so that the first oil seal fastens the ring gear. For example, when the lip portion of the first oil seal is slid on the sliding portion of the ring gear having the taper shape, the lip portion can fasten the ring gear. By virtue of tension with which the first oil seal fastens the ring gear, the ring gear receives the thrust force towards the main body block, and is forced away from the flywheel. Thus, it is possible to reduce the abrasion and the thrust sound of the ring gear and the flywheel, caused by the sliding of the ring gear by the flywheel. Moreover, it is also possible to reduce the generation of heat, caused by the contact of the ring gear and the flywheel, after the start of the internal combustion engine. It is also possible to reduce the deterioration of the first and second oil seals caused by heat.

In another aspect of the first or second starting apparatus of the present invention, the one-way clutch is located on an inner side of the second oil seal in the radial direction.

According to this aspect, it is possible to reduce the leakage of the lubricant from the flywheel side of the ring gear, in which the lubricant is supplied to the one-way clutch by the centrifugal force caused by the rotation of the ring gear, if the lubricant is supplied from the inner side of the one-way clutch in the radial direction of the ring gear.

In another aspect of the first or second starting apparatus of the present invention, an oil exhaust channel which penetrates from the side of the flywheel to the side of the main body block is located in an inner area of seal surfaces of the first and second oil seals in the radial direction, in the ring gear.

According to this aspect, the lubricant supplied to the one-way clutch can be exhausted to the exterior of the apparatus through the oil exhaust channel. Thus, it is possible to reduce the accumulation of the lubricant supplied to the one-way clutch, in the apparatus. More specifically, the oil exhaust channel is located in the inner side of the seal surface of the second oil seal in the radial direction of the ring gear, so that it is possible to flow or feed the lubricant of a sufficient amount to the one-way clutch, as well as smoothly flow the lubricant in the apparatus. Moreover, by locating the oil exhaust channel in the inner side of the seal surface of the first oil seal in the radial direction of the ring gear, it is possible to prevent the accumulation of the lubricant of an amount beyond the sealability of the first oil seal, near the first oil seal. Therefore, while the lubricant is flown in the apparatus, it is possible to reduce the leakage of the lubricant to the exterior of the apparatus, more effectively. At the same time, it is possible to smoothly operate the one-way clutch or the like by reducing sludge or foreign substances accumulated in an oil pool.

In another aspect of the first or second starting apparatus of the present invention, it is further provided with: a bearing, which is located on an inner side of the one-say clutch in the radial direction, for rollably supporting the ring gear; and an oil supply channel which is located on an inner side of a rolling surface of the bearing in the radial direction.

According to this aspect, by supplying the lubricant from the oil supply channel, which is located on the inner side of the one-way clutch and the bearing in the radial direction of the ring gear, it is possible to feed or flow the lubricant to the one-way clutch and the bearing, by the centrifugal force in the rotation of the ring gear. Therefore, it is possible to reduce the abrasion and the burning of the one-way clutch and the bearing.

In another aspect of the first or second starting apparatus of the present invention, the first oil seal faces to the main body block through a retainer, at least partially, and oil-seals between the ring gear and the retainer.

According to this aspect, for example, even after the main body block and an oil pan are assembled, it is possible to fix the first oil seal onto the main body block.

These functions and other advantages of the present invention will be apparent from the following description of embodiments.

BEST MODE FOR CARRYING OUT THE INVENTION

With reference to FIG. 1 to FIG. 4, a starting apparatus according to an embodiment of the present invention will be explained. Incidentally, in the embodiment below, the starting apparatus of the present invention is applied to a starting apparatus of the engine which performs the Ecorun in a constant mesh gear manner (i.e., a constant engaged gear manner). Incidentally, a "peripheral velocity" used in the embodiment means a velocity in the rotational direction when a ring gear and a flywheel, described later, rotate. A "relative velocity" used in the embodiment means the peripheral velocity of the flywheel viewed from the ring gear, or the peripheral velocity of the ring gear viewed from the flywheel, for example.

Figure 1:
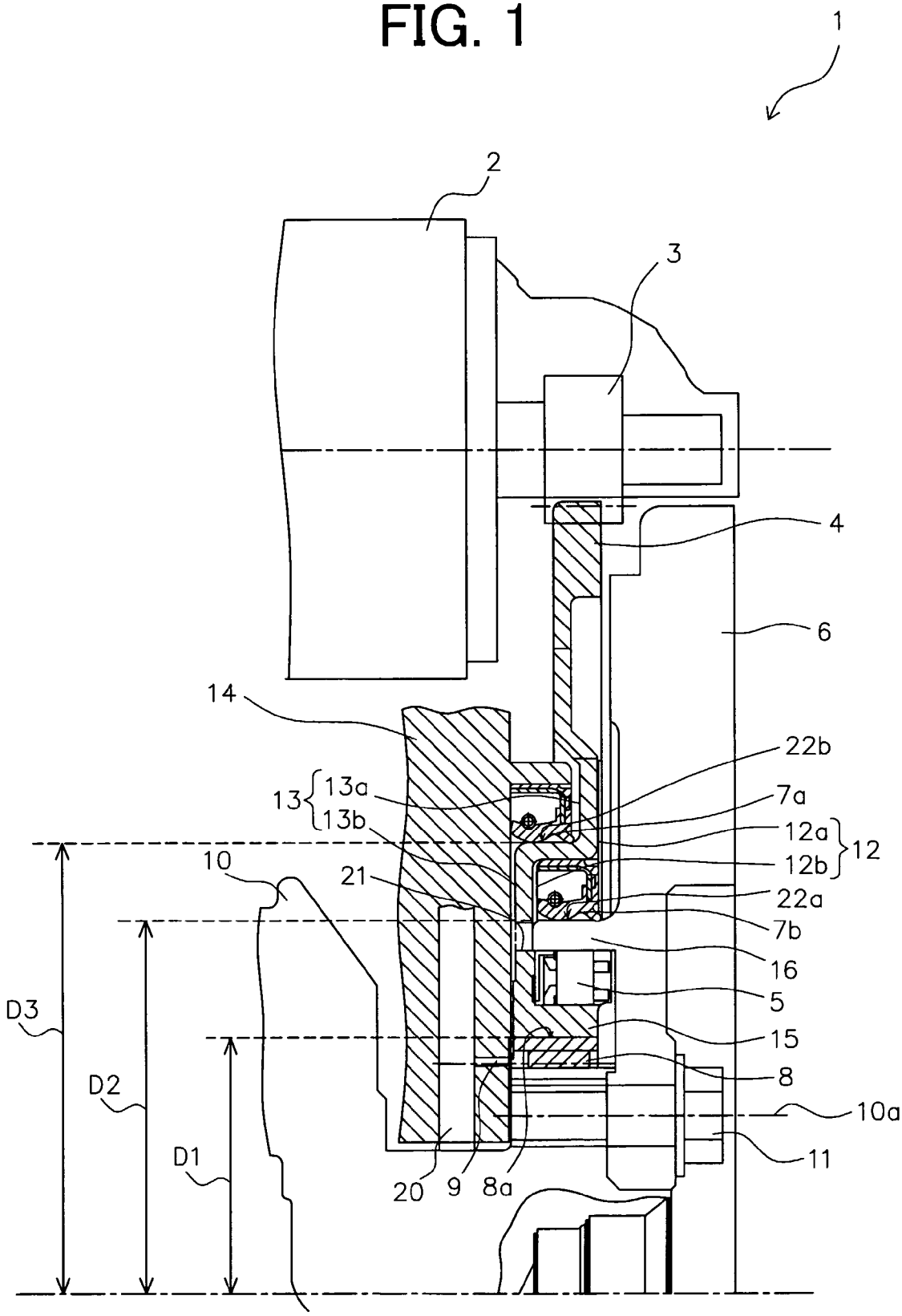
FIG. 1 is a cross sectional view showing one example of a starting apparatus in an embodiment of the present invention, with it partially broken in the axis line direction of a ring gear.
Figure 2:
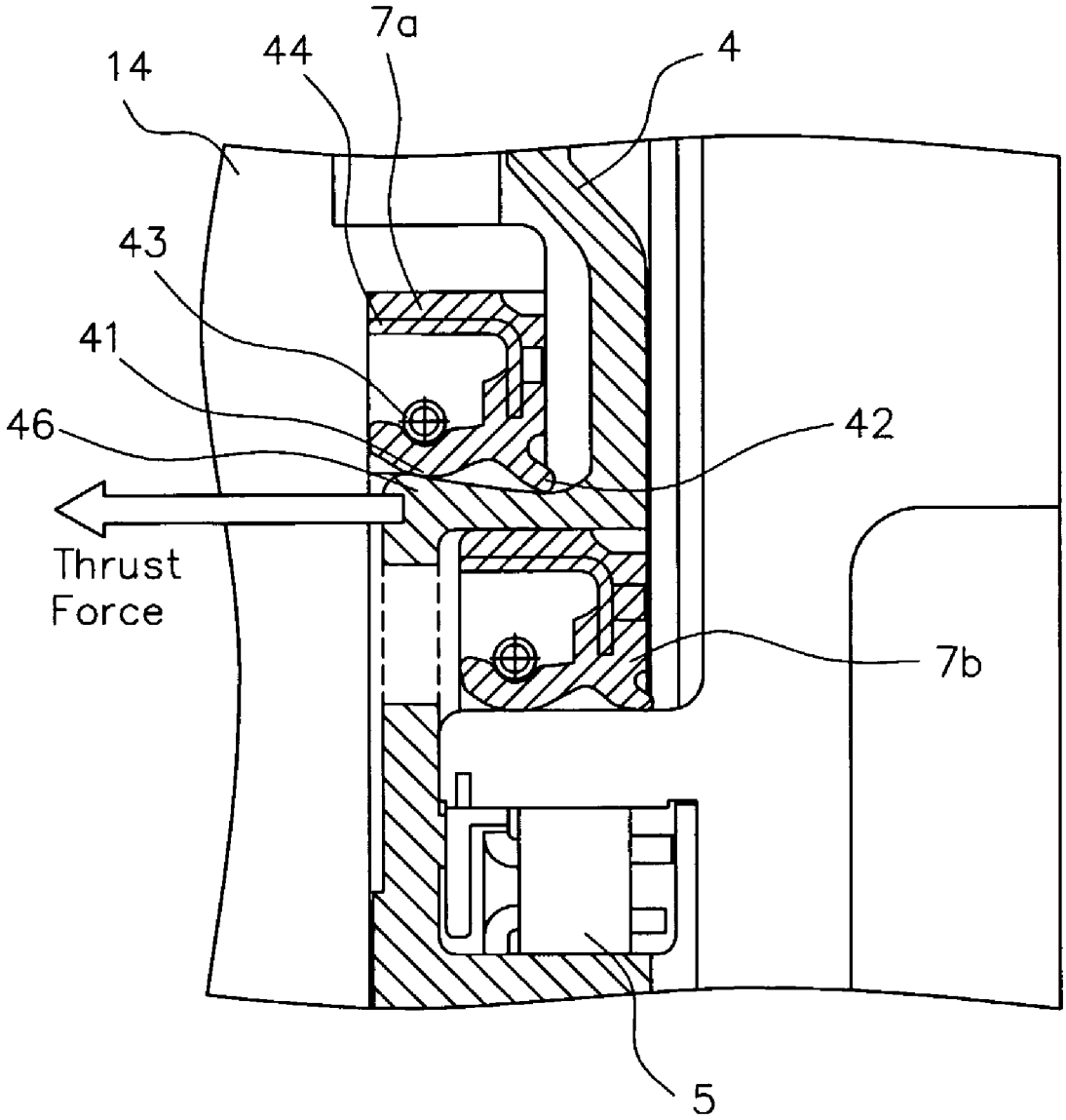
FIG. 2 is an enlarged view showing one portion of FIG. 1.

FIG. 1 shows one example of the starting apparatus in the embodiment, with it partially broken in the axis line direction of the ring gear. FIG. 2 is an enlarged view showing one portion of FIG. 1.

In FIG. 1, a starting apparatus 1 in the embodiment is provided with: a starting motor 2; a pinion gear 3, which is coaxially mounted on the rotation output shaft of the starting motor 2; a ring gear 4, which is always meshed (or engaged) with the pinion gear 3; a one-way clutch 5, which transmits a rotational force only in one direction; an oil seal 7*a*, which is located on the cylinder block 14-side of the ring gear 4 (i.e., the side or side surface, which faces to the cylinder block 14, of the ring gear 4); an oil seal 7*b*, which is located on the flywheel 6-side of the ring gear 4 (i.e., the side or side surface, which faces to the flywheel 6, of the ring gear 4); a roller bearing 8, which rollably or rotatably supports the ring gear 4; and an oil supply channel 9 for supplying lubricant into the starting apparatus 1. Incidentally, the cylinder block 14 is one example of the "main body block" of the present invention. The main body block is not limited to the cylinder block 14, and may be anything located on the left side of the ring gear in FIG. 1.

The ring gear 4 transmits a rotational force for starting, which is generated on the starting motor 2 upon starting the engine and upon restarting the engine from the idling stop condition, to a crankshaft 10 through the one-way clutch 5 and the flywheel 6. The flywheel 6 and the crankshaft 10 are connected by a bolt 11. The rotation of the flywheel 6 causes the rotation of the crankshaft 10. This causes the rotation of a crank which is connected to the crankshaft 10, to thereby start the main drive of the engine. The main drive of the engine herein means to generate a rotational force for driving by combusting fuel in the engine main body. Therefore, after the start of the engine, the engine is driven by the rotational force for driving, and the flywheel 6, which is connected to the crankshaft 10, rotates at high speed, along with the main drive of the engine. The ring gear 4 has a plate shape extending in the peripheral direction of a crank axis 10*a*. The ring gear 4 is located coaxially with respect to the crank axis 10*a*, and is rollably supported by the rolling surface of a roller bearing 8.

The external form of the ring gear 4 is a ring shape coaxial with the crankshaft 10, and the cross sectional form of the ring gear 4 cut in the peripheral direction of the ring gear 4, i.e. in a direction crossing the rotational direction of the ring gear 4 at the start of the engine is a concavo-convex shape (i.e., a concave-convex shape). The surface on the flywheel 6-side of the ring gear 4, i.e. the surface on the right side of the ring gear 4 in FIG. 1, has a first concavo-convex portion 12 provided with a first convex portion 12*a* and a first concave portion 12*b*, which are located in this order from the outer side in the radial direction of the ring gear 4. The surface on the cylinder block 14-side of the ring gear 4, i.e. the surface on the left side of the ring gear 4 in FIG. 1, has a second concavo-convex portion 13 provided with a second concave portion 13*a* and a second convex portion 13*b*, which are located in this order from the outer side in the radial direction of the ring gear 4.

The first concave portion 12*b* is open toward the flywheel 6, and the second concave portion 13*a* is open toward the cylinder block 14. In the radial direction of the ring gear 4, the position of the first convex portion 12*a* coincides with the position of the second concave portion 13*a*, and the position of the first concave portion 12*b* coincides with the position of the second convex portion 13*b*. Namely, in FIG. 1, the second concave portion 13*a* is located on the left side of the first convex portion 12*a*, and the second convex portion 13*b* is located on the left side of the first concave portion 12*b*. The ring gear 4 is provided with a convex portion 15 in contact with the one-way clutch 5, aside from the first convex portion 12*a* and the second convex portion 13*b*.

The one-way clutch 5 is located on the flywheel 6-side, i.e. on the right side in FIG. 1, with respect to the ring gear 4. The one-way clutch 5 extends in the peripheral direction of the crankshaft 10, and is located coaxially with respect to the rotational axis of the crankshaft 10 and the ring gear 4. The one-way clutch 5 is located between the convex portion 15 of the ring gear 4, which projects toward the flywheel 6, and a convex portion 16 of the flywheel 6, which projects toward the ring gear 4. The one-way clutch 5 is in contact with the convex portion 16 of the flywheel 6 and the convex portion 15 of the ring gear 4. The one-way clutch 5 transmits the rotational force for starting from the ring gear 4 to the flywheel 6 at the start of the engine, while it prevents the rotational force for driving from being transmitted to the ring gear 4 after the start of the engine. More specifically, at the start of the engine by the starting apparatus 1, the one-way clutch 5 transmits the rotational force of the ring gear 4, i.e. the rotational force for starting, to the side of the flywheel 6, to thereby rotate the flywheel 6. On the other hand, after the start of the engine, the one-way clutch 5 runs idle even if the flywheel 6 is rotated by the rotational force for driving, so that the rotational force for driving is not transmitted from the flywheel 6 to the ring gear 4. For example, the one-way clutch 5 is provided with: an inner race; an outer race; and a sprag located between the inner race and the outer race. When the inner race rotates, the outer race is also rotated through the sprag. When the outer race rotates, the sprag does not transmit the rotational force of the outer race to the inner race, and the one-way clutch 5 runs idle. Namely, in FIG. 1, when the ring gear 4 rotates which is in contact with the inner race on the lower portion of the one-way clutch 5, the rotational force for driving is transmitted to the flywheel 6 which is in contact with the outer race on the upper portion of the one-way clutch 5. When the flywheel 6 rotates which is in contact with the outer race, the ring gear 4 which is in contact with the inner race is not rotated, and the rotational force for driving is not transmitted from the flywheel 6 to the ring gear 4. Incidentally, a thrust washer is located between the one-way clutch 5 and the flywheel 6.

The oil seal 7*a*, which is one example of the "first oil seal" of the present invention, is located on the cylinder block 14-side of the ring gear 4. More specifically, it is located on the inner side of the second concave portion 13*a*. Therefore, as compared to the case where an oil seal is located on one surface of a plate-like ring gear which does not have a concavo-convex shape, it is possible to reduce the size of the starting apparatus 1 in the thickness direction of the ring gear, by this much that the oil seal 7*a* is located on the inner side of the second concave portion 13*a*. In the cross section of the ring gear 4 cut in the direction crossing the peripheral direction of the ring gear 4, if the first convex portion 12*a* is not located on the right side of the second concave portion 13*a* in FIG. 1, it is possible to further reduce the size, by this much that the first convex portion 12*a* does not exist.

In the embodiment, the oil seal 7*a* is fixed on the cylinder block 14, and extends in the peripheral direction of the ring gear 4. The oil seal 7*a* is provided with: a spring, which is one example of an elastic body; a metal ring; a seal lip; and a dust lip. The lubricant is sealed by pressing the seal lip of the oil seal 7*a* onto one portion of the second concave portion 13*a* by the spring. At the start of the engine, the seal lip of the oil seal 7*a* prevents the leakage of the lubricant, and is slid in a partial area of the second concave portion 13*a*. After the start of the engine, the seal lip of the oil seal 7*a* is still pressed on the partial area of the second concave portion 13*a*, and seals the cylinder block 14-side of the ring gear 4.

The oil seal 7*b*, which is one example of the "second oil seal" of the present invention, is located on the flywheel 6-side of the ring gear 4. More specifically, it is located on the inner side of the first concave portion 12*b*. Therefore, as in the oil seal 7*a*, it is possible to reduce the size of the starting apparatus 1, by locating the oil seal 7*b* on the inner side of the first concave portion 12*b*.

In the embodiment, the oil seal 7*b* has the same structure as that of the oil seal 7*a*. The flywheel 6-side of the ring gear 4 is sealed by pressing the oil seal 7*b* onto the first concave portion 12*b*. After the start of the engine, the oil seal 7*b* prevents the leakage of the lubricant, and is slid in a partial area of the first concave portion 12*b*. Even at the start of the engine, the seal lip of the oil seal 7*b* is pressed on the partial area of the first concave portion 12*b*, and seals the flywheel 6-side of the ring gear 4. Therefore, by virtue of the oil seals 7*a* and 7*b*, it is possible to oil-seal the cylinder block 14-side and the flywheel 6-side of the ring gear 4, respectively. At the same time, it is also possible to reduce the size of the starting apparatus 1 (particularly, the thickness in the horizontal direction in FIG. 1).

Figure 5A:
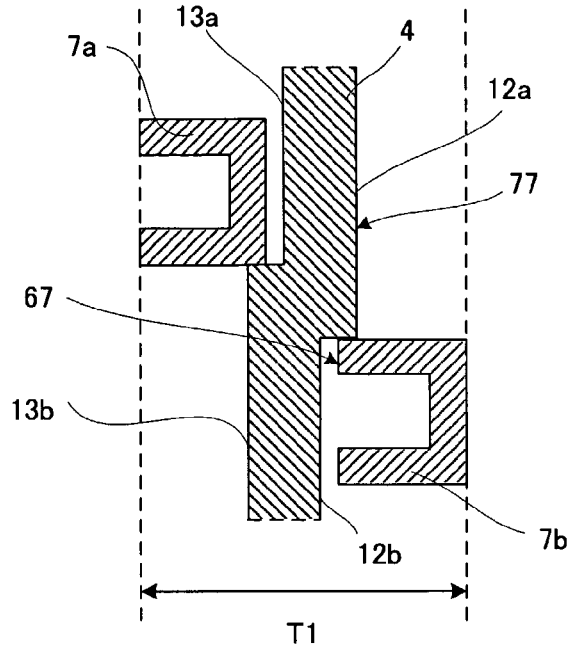
FIG. 5(*a*) and FIG. 5(*b*) are arrangement diagrams schematically showing positional relationships of portions in the vicinity of the ring gear.
Figure 5B:
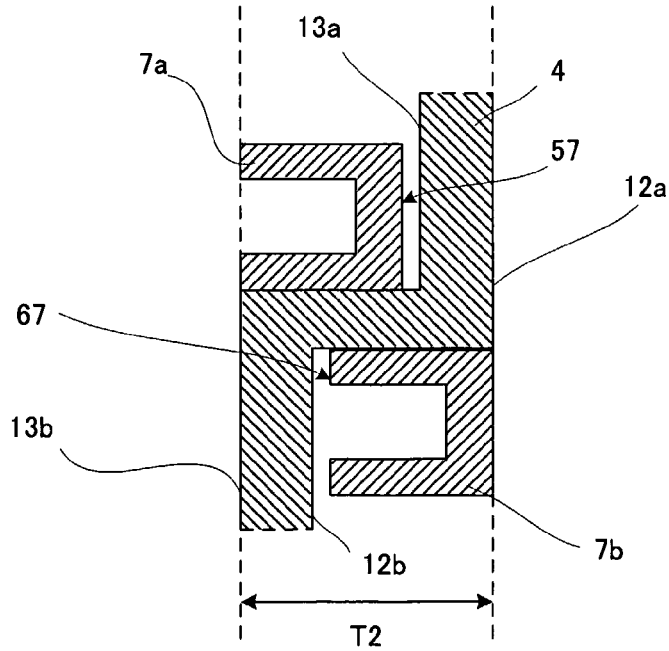

Here, with reference to FIG. 5(*a*) and FIG. 5(*b*), positional relationships among the first concave portion, the first convex portion, the second concave portion, the second convex portion, the first oil seal, and the second oil seal will be explained in detail. FIG. 5(*a*) and FIG. 5(*b*) are arrangement diagrams schematically showing positional relationships among the concave portions, the convex portions, and the oil seals. Incidentally, what is important in FIG. 5(*a*) and FIG. 5(*b*) is the positional relationships among the first concave portion, the first convex portion, the second concave portion, the second convex portion, the first oil seal, and the second oil seal, so that FIG. 5(*a*) and FIG. 5(*b*) are drawn by omitting the detailed shape of each of the concave portions, the convex portions, and the oil seals.

In FIG. 5(*a*) and FIG. 5(*b*), the second concave portion 13*a* is located on the outer side of the first concave portion 12*b* in the radial direction of the ring gear 4, and the first oil seal 7*a* is located on the inner side of the second concave portion 13*a*. The second oil seal 7*b* is located on the inner side of the first concave portion 12*b*. In addition, the first concave portion 12*b* is located on the right side in FIG. 5(*a*) and FIG. 5(*b*), which is the reversed side of the second convex portion 13*b*, i.e. on the side of the flywheel 6 viewed from the second convex portion 13*b* with the ring gear 4 between, to be inextricably linked with the second convex portion 13*b*. Moreover, the second concave portion 13*a* is located on the left side in FIG. 5(*a*) and FIG. 5(*b*), which is the reversed side of the first convex portion 12*a*, i.e. on the side of the cylinder block 14 viewed from the first convex portion 12*a* with the ring gear 4 between, to be inextricably linked with the first convex portion 12*a*.

In FIG. 5(*a*), an end face 67 of the second oil seal 7*b* on it's cylinder block 14-side is located closer to the cylinder block 14 than a surface 77 of the first convex portion 12*a* on it's flywheel 6-side is, on the cross section of the ring gear 4 cut in the direction crossing the peripheral direction of the ring gear 4. Incidentally, in the embodiment, the situation that the end face 67 of the second oil seal 7*b* is located closer to the cylinder block 14 than the surface 77 is, is defined as "projecting to the side of the flywheel". In this case, it is possible to make a thickness T1 of a portion constructed from the first oil seal 7*a*, the ring gear 4, and the second oil seal 7*b*, smaller than a size obtained by simply adding the thicknesses of the first oil seal 7*a*, the ring gear 4, and the second oil seal 7*b*.

Moreover, as shown in FIG. 5(*b*), the end face 67 may be located closer to the cylinder block 14 than an end face 57 of the first oil seal 7*a* on its flywheel 6-side is. In this case, as compared to the case shown in FIG. 5(*a*), it is possible to make a thickness T2 of a portion constructed from the first oil seal 7*a*, the ring gear 4, and the second oil seal 7*b*, much smaller than the size obtained by simply adding the thicknesses of the first oil seal 7*a*, the ring gear 4, and the second oil seal 7*b*, which is more preferable to reduce the size or thickness of the starting apparatus as a whole.

Therefore, according to the arrangement of the concave portions, the convex portions, and the oil seals shown in FIG. 5(*a*) and FIG. 5(*b*), it is also possible to reduce the size of the internal combustion engine. From another standpoint, it is also possible to reduce a space for the starting apparatus to be located, and by that much, it is also possible to increase a space for other mechanisms located around the apparatus.

Next, while the operation of the starting apparatus 1 at the start and after the start of the engine is explained, the key content of the present invention will be explained. The starting apparatus 1 of the present invention has a particularly appropriate structure, as the starting apparatus of a constant mesh type for restarting the engine in the Ecorun.

In FIG. 1, in the horizontal or lateral direction, i.e. in the thickness direction of the ring gear 4, the oil seal 7*a* is located on the cylinder block 14-side of the ring gear 4, and the oil seal 7*b* is located on the flywheel 6-side of the ring gear 4. Moreover, in the vertical direction in FIG. 1, i.e. in the radial direction of the ring gear 4, the oil seal 7*a* is located on the outer side of the oil seal 7*b*.

At the start of the engine, the ring gear 4 is rotated by the rotational force for starting, generated on the starting motor 2. The rotational force for starting is transmitted to the flywheel 6 through the one-way clutch 5, so that the flywheel 6 rotates with the ring gear 4. Therefore, at the start of the engine, the relative velocity in the rotational direction between the ring gear 4 and the flywheel 6 is zero. The cylinder block 14 does not rotate at the start of the engine. Therefore, at the start of the engine, the relative velocity of the cylinder block 14 and the ring gear 4 in the rotational direction of the ring gear 4 is not zero.

After the start of the engine, the one-way clutch 5 runs idle, and the ring gear 4 stops while the flywheel 6 is rotated. Therefore, after the start of the engine, the relative velocity in the rotational direction of the ring gear 4 and the flywheel 6 is not zero. After the start of the engine, the ring gear 4 stops, so that the relative velocity between the ring gear 4 and the cylinder block 14 in the peripheral direction of the ring gear 4 is almost zero.

Now, the relative velocity on the sliding surface of the oil seal 7*a* and the ring gear 4 and the relative velocity of the oil seal 7*b* and the sliding surface of the flywheel 6 will be considered, on ground of the relative velocity among the cylinder block 14, the ring gear 4, and the flywheel 6 at the start and after the start of the engine described above.

The oil seal 7*a* is fixed on the cylinder block 14, and the peripheral velocity of the oil seal 7*a* is zero at the start of the engine. The ring gear 4 is rotated by the rotational force for starting. Therefore, at the start of the engine, the relative velocity of the oil seal 7*a* and the sliding surface of the ring gear 4, which slide each other, is not zero.

However, the seal lip of the oil seal 7*a* is only slid on the ring gear 4 in a short time, such as at the start of the engine. Moreover, at the start of the engine, the ring gear 4 is rotated at a relatively low speed, as a previous stage of the completion of the start of the engine. Thus, even if the relative velocity of the oil seal 7*a* and the ring gear 4 which slide each other increases by this much that the oil seal 7*a* is located on the outer side of the oil seal 7*b* in the radial direction of the ring gear 4, the oil seal 7*a* has a small degree of the deterioration, caused by this much of the increase in the relative velocity. Moreover, the oil seal 7*a* is located on the cylinder block 14-side of the ring gear 4. Thus, after the start of the engine, the relative velocity of the oil seal 7*a* and the ring gear 4 is zero. Therefore, after the start of the engine, the seal lip of the oil seal 7*a* is not slid on the ring gear 4, and the oil seal 7*a* hardly deteriorates.

The oil seal 7*b* is fixed on the ring gear 4, and the seal lip of the oil seal 7*b* is slid on the flywheel 6 after the start of the engine. However, in the radial direction of the ring gear 4, the oil seal 7*b* is located on the inner side of the oil seal 7*a*. Thus, when the oil seal 7*b* is slid on the flywheel 6, the relative velocity between the oil seal 7*b* and the flywheel 6 is small, which prevents the deterioration of the seal lip of the oil seal 7*b*. Moreover, according to the starting apparatus 1, it is possible to prevent the generation of heat caused by the sliding of the oil seals 7*a* and 7*b*. For example, if the oil seals 7*a* and 7*b* are mainly formed of a synthetic resin material, it is possible to prevent the deterioration of the oil seals caused by heat.

As described above, by locating the oil seals 7*a* and 7*b* at different positions in the radial direction of the ring gear 4, it is possible to prevent the deterioration of the oil seals at the start and after the start of the engine. Thus, it is possible to maintain the oil sealability of the starting apparatus 1 and improve the reliability of the starting apparatus 1. Incidentally, this is not limited to the seal lip of the oil seal, but the deterioration of the dust lip is also prevented in the same manner.

Next, an explanation will be given to a structure for reducing abrasion and a thrust sound, caused by the contact of the ring gear and the flywheel after the start of the engine. Incidentally, in the embodiment, the oil seal 7*a* has a structure for generating a thrust force described later. The present invention, however, is not limited to this, and the oil seal 7*b* may have the structure for generating the thrust force. Moreover, both the oil seals 7*a* and 7*b* may have the structure for generating the thrust force.

In FIG. 1 and FIG. 2, the oil seal 7*a* is provided with: a seal lip 41; a dust lip 42; a spring 43, which is one example of the "elastic body" of the present invention; and a metal ring 44. The ring gear 4 is provided with a ring gear sliding portion 46, which is slid on the seal lip 41 and the dust lip 42. The seal lip 41 and the dust lip 42 are pressed onto the ring gear sliding portion 46 by the spring 43. In the cross section of the ring gear 4 cut in the direction crossing the peripheral direction of the ring gear 4, the cross sectional form of the ring gear sliding portion 46 in contact with the seal lip 41 of the oil seal 7*a* is a taper shape which becomes gradually narrower towards the ring gear 4.

At the start of the engine, after the ring gear 4 transmits the rotational force for starting to the crankshaft 10 through the one-way clutch 5 and the flywheel 6, the oil seal 7*a* generates tension, with which the ring gear 4 is fastened, with respect to the ring gear 4. Since the cross sectional form of the ring gear sliding portion 46 is the above-mentioned taper shape, the ring gear 4 receives the thrust force so that the ring gear 4 is forced away from the flywheel 6 by the tension of the oil seal 7*a*. After the start of the engine, the ring gear 4 and the flywheel 6 come out of contact with each other.

Therefore, after the start of the engine, the ring gear 4 is out of contact with the flywheel 6 which rotates at high speed together with the main drive of the engine, so that it is possible to reduce the abrasion of the ring gear 4 and the flywheel 6, and furthermore, it is also possible to reduce the thrust sound caused by the contact of the ring gear 4 with the flywheel 6. In addition, the generation of heat, caused by the abrasion between the ring gear 4 and the flywheel 6, can be also reduced, so that it is possible to prevent the deterioration of the oil seals 7*a* and 7*b* caused by heat. As a result, it is possible to operate the starting apparatus 1 without any problems for a long period of time.

Again, with reference to FIG. 1, a structure for smoothly flowing the lubricant in the starting apparatus 1 will be explained.

In FIG. 1, the oil supply channel 9 is located in the cylinder block 14. The oil supply channel 9 is located on the lower side of a rolling surface 8*a* on which the roller bearing 8 rollably supports the ring gear 4 in the radial direction of the ring gear 4. Namely, the position of the oil supply channel 9 in the radial direction of the ring gear 4 is where it is smaller than a radius D1 to the rolling surface 8*a*. A lubrication channel 20 located in a crank main journal supplies the lubricant to the roller bearing 8 through the oil supply channel 9.

The roller bearing 8, the one-way clutch 5, the oil seal 7*b*, and the oil seal 7*a* are located in this order from the inner side in the radial direction of the ring gear 4. Therefore, the lubricant supplied from the oil supply channel 9 to the roller bearing 8 is flown to the rolling surface 8*a*, and then, by a centrifugal force caused by the rotation of the crankshaft 10, is supplied to the roller bearing 8 and the one-way clutch 5. By supplying the lubricant to the roller bearing 8 and the one-way clutch 5, it is possible to reduce the abrasion and the burning of the rolling surface 8*a* and the one-way clutch 5, to thereby reduce the start trouble of the starting apparatus 1. Moreover, the oil seals 7*a* and 7*b* seal the cylinder block 14-side and the flywheel 6-side of the ring gear 4, respectively. By this, it is possible to reduce the leakage of the lubricant from the starting apparatus 1 to the exterior.

Furthermore, the ring gear 4 is provided with an oil exhaust channel 21 which penetrates from the flywheel 6-side to the cylinder block 14-side of the ring gear 4, in an inner area of the oil seals 7*a* and 7*b* in the radial direction of the ring gear 4. More specifically, the oil exhaust channel 21 is located on the lower side of a seal surface 22*a* on which the oil seal 7*b* is in contact with the top surface of the convex portion 16 of the flywheel 6, and is located on the lower side of a seal surface 22*b* on which the oil seal 7*a* is in contact with the bottom surface of the second concave portion 13*a* of the ring gear 4. Namely, the oil exhaust channel 21 in the radial direction of the ring gear 4 is located on the lower side of a position shown by a radius D2 to the seal surface 22*a*, and is located on the lower side of a position shown by a radius D3 to the seal surface 22*b*. Moreover, the oil exhaust channel 21 is located on the outer side of the one-way clutch 5 in the radial direction of the ring gear 4.

By virtue of the oil exhaust channel 21, the lubricant which flows on the roller bearing 8 and the one-way clutch 5 is exhausted to the exterior of the apparatus by the centrifugal force of the crankshaft 10. Therefore, the passage of the lubricant is formed over the oil supply channel 9, the roller bearing 8, the one-way clutch 5, and the oil exhaust channel 21. By virtue of the passage of the lubricant, it is possible to smoothly flow the lubricant in the starting apparatus 1, and it is possible to reduce the operational malfunction of the ring gear 4, the one-way clutch 5, and the roller bearing 8, due to sludge or foreign substances accumulated in the starting apparatus 1. This makes it possible to increase the startability of the starting apparatus 1 and to extend the lifetime of the starting apparatus 1 in which it can be operated without any problems. Moreover, by virtue of the oil exhaust channel 21, it is possible to prevent that the lubricant flown out from the side of the cylinder block 14 is flown to the side of the flywheel 6 through the oil exhaust channel 21 and is directly exhausted to the exterior.

Figure 3:
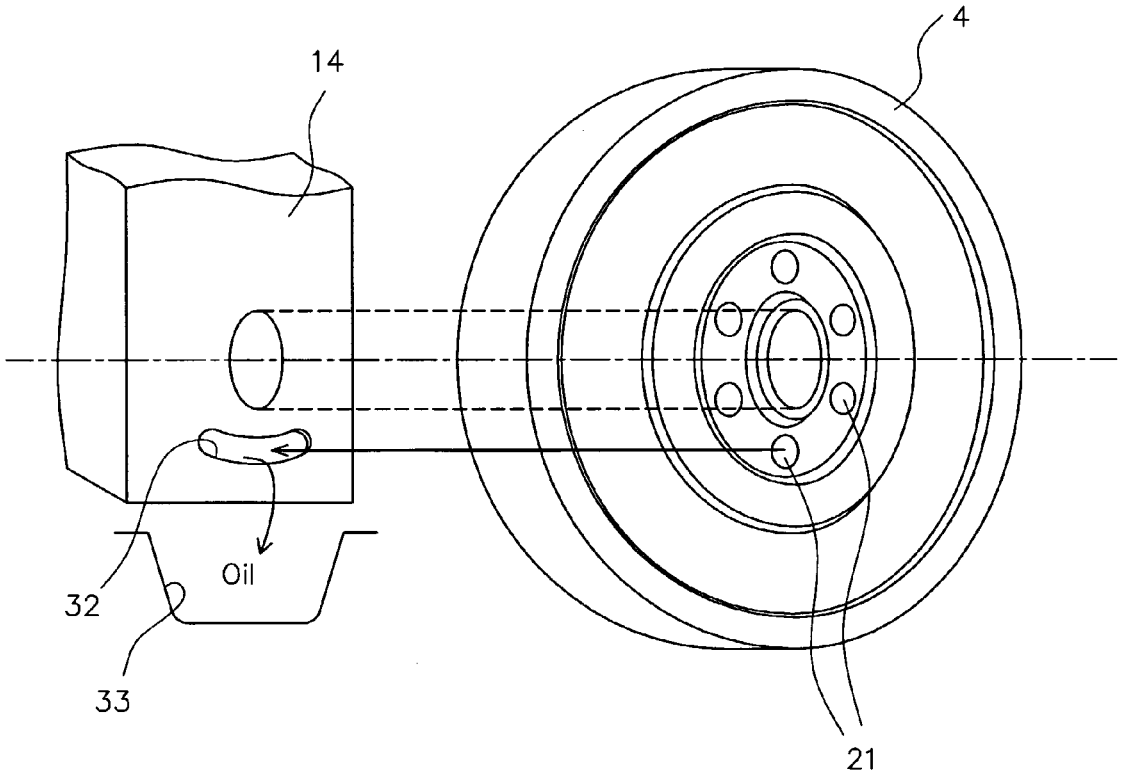
FIG. 3 is a schematic diagram showing a passage for exhausting lubricant of the starting apparatus in the embodiment.

With reference to FIG. 1 and FIG. 3, the passage for exhausting the lubricant will be explained in more detail. FIG. 3 schematically shows the passage for exhausting the lubricant.

With reference to FIG. 1 and FIG. 3, after flown on the roller bearing 8 and the one-way clutch 5 provided for the starting apparatus 1, the lubricant is exhausted from the oil exhaust channel 21 to an oil receiving hole 32 of the cylinder block 14. A plurality of oil exhaust channels 21 are provided in the peripheral direction of the ring gear 4. The cylinder block 14 is provided with the oil receiving hole 32 for receiving the lubricant from the oil exhaust channel 21 of the ring gear 4. Every time the oil exhaust channel 21 comes back to the position of the oil receiving hole 32 by the rotation of the ring gear 4, the lubricant is exhausted to the oil receiving hole 32. The lubricant is exhausted from the oil receiving hole 32 to an oil pan 33 located on the lower side of the cylinder block 14. It is also possible to supply the lubricant exhausted to the oil pan 33 to the starting apparatus 1 again by using a pump, which allows for the circulation of the lubricant in the starting apparatus 1.

Figure 4:
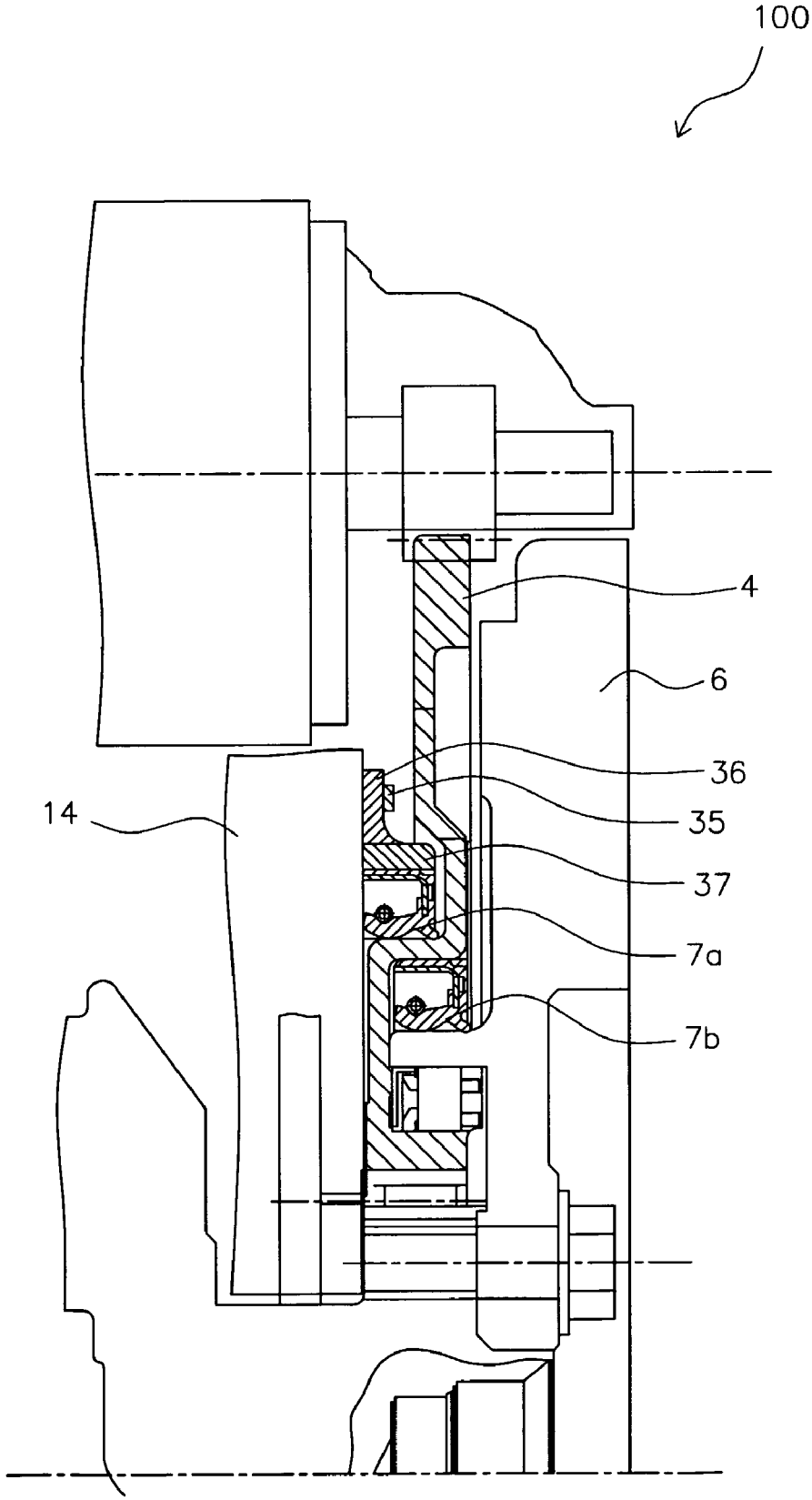
FIG. 4 is a cross sectional view showing another example of the starting apparatus in the embodiment, with it partially broken in the axis line direction of a ring gear.

Next, with reference to FIG. 4, another example of the starting apparatus of the present invention will be explained. FIG. 4 shows a starting apparatus 100 in another example, with it partially broken in the axis line direction of the rotational axis of the ring gear 4. Incidentally, in FIG. 4, the common parts with those of the starting apparatus 1 carry the common reference numerals, and the detailed explanation of the common structure will be omitted.

The starting apparatus 100 in this example has a feature in that the oil seal 7*a* is fixed on the cylinder block 14 through a retainer 36. The oil seal 7*a* faces the cylinder block 14 through the retainer 36, at least partially, and seals between the ring gear 4 and the cylinder block 14. In the embodiment, the retainer 36 fixes the oil seal 7*a* on the cylinder block 14 through a flange 37. The retainer 36 fixed on the cylinder block 14 by a bolt 35 allows the oil seal 7*a* to be located onto the cylinder block 14-side of the ring gear 4 after the cylinder block 14 and the oil pan 33 are assembled. The retainer 36 extends in the peripheral direction of the ring gear 4, and fixes the oil seal 7*a* in the peripheral direction of the ring gear 4. The retainer 36 is mainly formed of metal, such as aluminum. As described above, even the case where various members are located between the ring gear 4 and the cylinder block 14 does not depart from the concept of the present invention. Moreover, even the case where an auxiliary plate or the like is located between the ring gear 4 and the flywheel 6 does not depart from the concept of the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

INDUSTRIAL APPLICABILITY

A starting apparatus of the present invention can be applied to a starting apparatus mounted on a vehicle, and particularly, it can be applied to a starting apparatus of a constant mesh gear type.

The invention claimed is:

1. A starting apparatus for starting an internal combustion engine, which is provided with a flywheel connected to a crankshaft and which has a main body block, comprising:

a starting motor for generating a rotational force for starting, upon starting of the internal combustion engine;

a ring gear for transmitting the rotational force for starting, from a side of said starting motor to a side of said flywheel;

a one-way clutch, which is located between said ring gear and said flywheel, for transmitting the rotational force for starting, from a side of said ring gear to the side of said flywheel and preventing transmission of a rotational force for driving of the internal combustion engine, from the side of said flywheel to the side of said ring gear;

a first oil seal for oil-sealing a side, which faces to said main body block, of said ring gear; and a second oil seal for oil-sealing a side, which faces to said flywheel, of said ring gear, said first oil seal being located on an outer side of said second oil seal in a radial direction of said ring gear.

2. The starting apparatus according to claim 1, wherein said ring gear comprises: a first concavo-convex portion including a first convex portion which projects to the side of said flywheel and a first concave portion which is open to the side of said flywheel; and a second concavo-convex portion including a second convex portion which projects to the side of said main body block and a second concave portion which is open to the side of said main body block, said second concave portion is located on the outer side of the first concave portion in the radial direction, said first oil seal is located in the second concave portion, and said second oil seal is located in the first concave portion.

3. The starting apparatus according to claim 2, wherein the first concave portion is located on a reverse side of the second convex portion to be inextricably linked with the second convex portion, the second concave portion is located on a reverse side of the first convex portion to be inextricably linked with the first convex portion, and an end face of said second oil seal on a side thereof facing to said main body block is located closer to said main body block than an end face of said first oil seal on a side thereof facing to said flywheel is or than a surface of the first convex portion on a side thereof facing to said flywheel is, on a cross section of the ring gear cut in a direction crossing a peripheral direction of the ring gear.

4. The starting apparatus according to claim 1, wherein at least one of said first and second oil seals is constructed to generate a thrust force which forces said ring gear away from said flywheel.

5. The starting apparatus according to claim 4, wherein said first oil seal extends in a peripheral direction of said ring gear, and a cross sectional form of a sliding portion of said ring gear cut in a direction crossing the peripheral direction in said first oil seal is a taper shape which becomes gradually narrower towards the side of said flywheel to thereby generate the thrust force.

6. The starting apparatus according to claim 1, wherein said one-way clutch is located on an inner side of said second oil seal in the radial direction.

7. The starting apparatus according to claim 1, wherein an oil exhaust channel which penetrates from the side of said flywheel to the side of said main body block is located in an inner area of seal surfaces of said first and second oil seals in the radial direction, in said ring gear.

8. The starting apparatus according to claim 1, further comprising:

a bearing, which is located on an inner side of said one-say clutch in the radial direction, for rollably supporting said ring gear; and an oil supply channel which is located on an inner side of a rolling surface of said bearing in the radial direction.

9. The starting apparatus according to claim 1, wherein said first oil seal faces to said main body block through a retainer, at least partially, and oil-seals between said ring gear and the retainer.

10. A starting apparatus for starting an internal combustion engine, which is provided with a flywheel connected to a crankshaft and which has a main body block, comprising:

a starting motor for generating a rotational force for starting, upon starting of the internal combustion engine;

a ring gear for transmitting the rotational force for starting, to a side of said flywheel;

a one-way clutch, which is located between said ring gear and said flywheel, for transmitting the rotational force for starting, from a side of said ring gear to the side of said flywheel and preventing transmission of a rotational force for driving of the internal combustion engine, from the side of said flywheel to the side of said ring gear;

a first oil seal for oil-sealing a side, which faces to said main body block, of said ring gear; and a second oil seal for oil-sealing a side, which faces to said flywheel, of said ring gear, at least one of said first and second oil seals being constructed to generate a thrust force which forces said ring gear away from said flywheel.

11. The starting apparatus according to claim 10, wherein said first oil seal extends in a peripheral direction of said ring gear, and a cross sectional form of a sliding portion of said ring gear cut in a direction crossing the peripheral direction in said first oil seal is a taper shape which becomes gradually narrower towards the side of said flywheel to thereby generate the thrust force.

12. The starting apparatus according to claim 10, wherein said one-way clutch is located on an inner side of said second oil seal in the radial direction.

13. The starting apparatus according to claim 10, wherein an oil exhaust channel which penetrates from the side of said flywheel to the side of said main body block is located in an inner area of seal surfaces of said first and second oil seals in the radial direction, in said ring gear.

14. The starting apparatus according to claim 10, further comprising:

a bearing, which is located on an inner side of said one-say clutch in the radial direction, for rollably supporting said ring gear; and an oil supply channel which is located on an inner side of a rolling surface of said bearing in the radial direction.

15. The starting apparatus according to claim 10, wherein said first oil seal faces to said main body block through a retainer, at least partially, and oil-seals between said ring gear and the retainer.

* * * * *